United States Patent [19]

Couton

[11] 4,060,857

[45] Dec. 6, 1977

[54] WATER FLUSHING DEVICE

[76] Inventor: Lucien Couton, 49-51 rue de Soissons, Casablanca, Morocco

[21] Appl. No.: 656,976

[22] Filed: Feb. 10, 1976

[30] Foreign Application Priority Data

June 2, 1975 Switzerland ..... 7071/75

[51] Int. Cl.[2] ..... E03D 1/36; E03D 3/10

[52] U.S. Cl. ..... 4/26; 4/41

[58] Field of Search ..... 4/20, 26, 30, 31, 33, 4/41, 52, 67 R; 137/102

[56] References Cited

U.S. PATENT DOCUMENTS

| | | | |
|---|---|---|---|
| 2,760,204 | 8/1956 | Joanis | 4/41 |
| 2,957,181 | 10/1960 | Lamping | 4/26 |
| 3,397,408 | 8/1968 | Skousgaard | 4/26 |
| 3,628,195 | 12/1971 | Skousgaard | 4/26 |

*Primary Examiner*—Henry K. Artis
*Assistant Examiner*—Stuart S. Levy
*Attorney, Agent, or Firm*—Emory L. Groff, Jr.

[57] ABSTRACT

A pressurized-tank water flushing device has a hydraulically controlled flushing valve operated by a control valve for selectively applying a pressure differential to an actuating piston, one face of which is permanently subjected to the tank pressure, and the other face either to the water supply, or to atmospheric pressure. The actuating piston has a hollow shank acting as a slide valve which switches on the supply of water to the tank when the flushing valve closes, and cuts off the supply of water to the tank when the flushing valve opens.

3 Claims, 3 Drawing Figures

WATER FLUSHING DEVICE

The invention relates to water flushing devices of the type in which the tank contains a volume of compressed air above the water level.

It is known that such pressure-operated flushing devices are advantageous in having a reduced water consumption. Generally, it is possible to clean a W.C. bowl with about half the water required by a conventional flushing device.

An object of the invention is to provide a pressure-operated flushing device of very reliable operation and which can be manufactured at relatively low cost.

To this end, a pressure-operated flushing device according to the invention comprises a hydraulic actuator controlling a tank-flushing valve. The actuator includes a piston functioning as an actuating member. The piston is movable as a function of the pressure in two distinct spaces, a first space located below the lower face of the piston and submitted to the pressure within the tank, and a second space located above the upper face of the piston and submitted selectively by a control valve to two pressures, an upper pressure able to move said member to close said flushing valve against the action of a spring biasing the flushing valve to an open flushing position, and a lower pressure which allows said flushing valve to open under the combined action of said spring and the pressure in said first space.

The accompanying drawings show, schematically and by way of example, a preferred embodiment of the invention.

Figure 1:
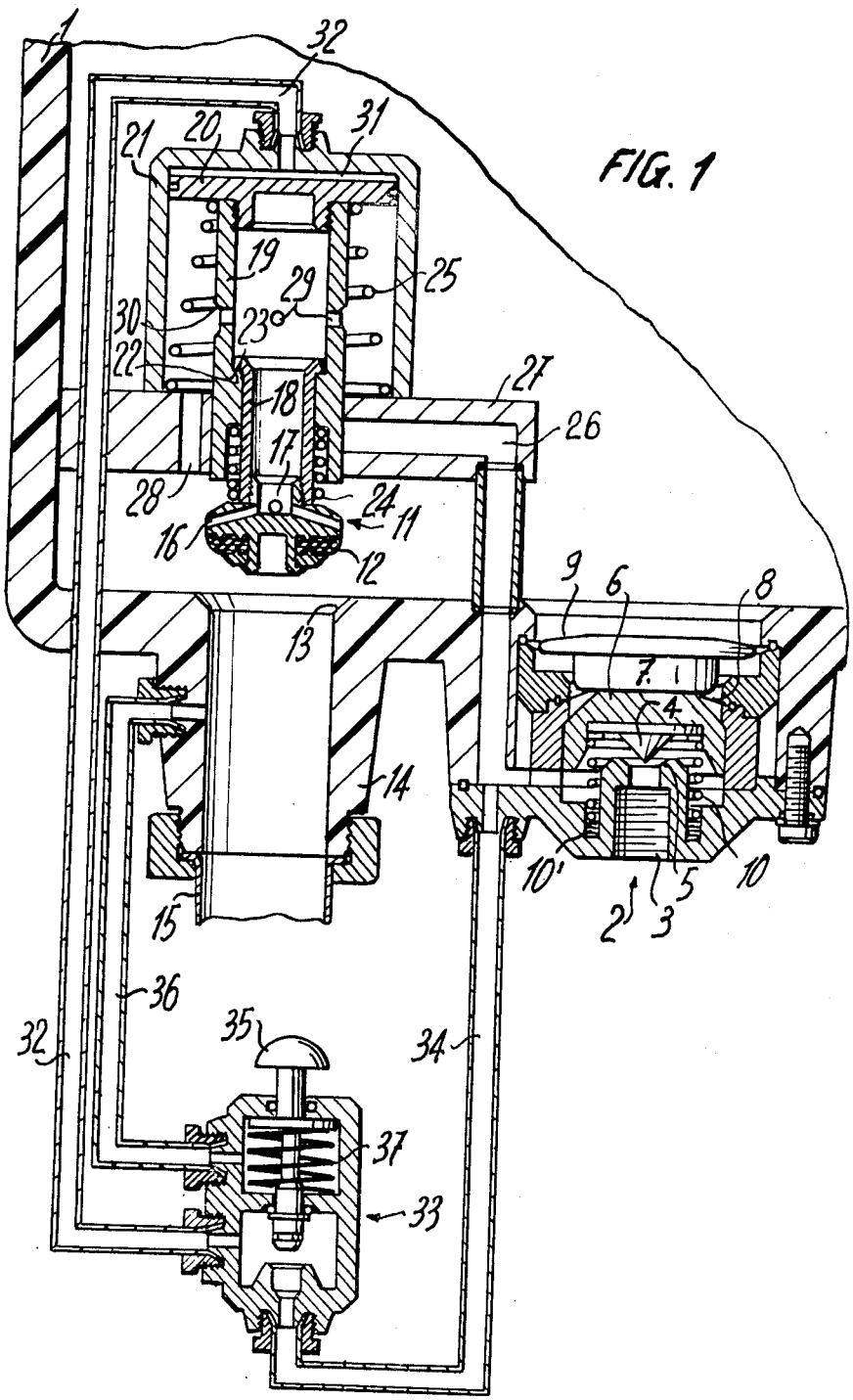
FIG. 1 is a partial cross-section of a water flushing device, showing the relevant parts when the tank is in its emptied condition.

The flushing device shown comprises a tank 1 of plastic material and only a part of which is shown. Tank 1 is fluid-tightly closed so as to be able to trap a quantity of compressed air above the water level.

The control of filling of tank 1 takes place by a valve 2 in the base of the tank. Water is delivered by a pipe, now shown, to a union 3 and the flow of water is controlled by a valve cone 4 cooperating with a seat 5. Cone 4 is moved by a differential piston formed in two parts 6 and 7 separated from one another by a membrane 8. The pressure in tank 1 acts on part 7 of the differential piston by means of a membrane 9. When this pressure is sufficient (i.e., reaches a given value), part 7 pushes cone 4 against seat 5, against the action of a biasing spring 10 tending to hold the valve cone 4 in the open position. Washers 10' of given thickness are placed to set the tension of spring 10, and consequently the desired limiting pressure in tank 1.

The outflow of the water under pressure contained in tank 1, via a flush pipe 15, is controlled by a flushing valve 11 carrying an elastomeric joint 12. This joint 12 is able to bear against a seat 13 at the inlet of a sleeve 14 to which the flush pipe 15 is connected.

Valve 11 has substantially radial ducts 16 connecting the tank 1 to a well 17 of the valve which communicates with a bore in a sleeve 18 supporting the valve. Sleeve 18 is slidably mounted in a hollow shank 19 of a piston 20 slidably mounted in a cylinder 21. The rest position of piston 20 and sleeve 18 is limited by abutment shoulders 22 and 23 of shank 19 and sleeve 18 respectively and by a spring 24 which holds these shoulders in contact.

When the piston 20 is not subjected to hydraulic pressure on its faces, it is held in the position shown in FIG. 1 by a spring 25. In this position, its hollow shank 19, which forms a hydraulic distribution slide valve, closes a duct 26 which is connected to the union 3 when cone 4 is open. This duct 26 is provided in a support plate 27 on which cylinder 21 is secured by thermoplastic welding or by an adhesive. The support plate 27 also has a duct 28 which places the inside of cylinder 21 under piston 20 into communication with the inside of tank 1. The hollow shank 19 of piston 20 has radial holes 29 leading into a groove 30 on the outer face of shank 19.

The space 31 situated in cylinder 21 above piston 20 communicates by means of a pipe 32 with a three-way control valve 33. In its rest position shown in FIG. 1, valve 33 places pipe 32 into communication with a pipe 34 which is branched to the duct 26 for delivering water into tank 1. When the manually-actuable plunger 35 of valve 33 is in the position shown in FIG. 3, pipe 32 is placed into communication with a pipe 36 leading into sleeve 14, i.e., to a location at atmospheric pressure. The plunger 35 of valve 33 is biased to the position of FIG. 1 by a spring 37.

Of course, pipes 32, 34 and 36 may have any desired length, so that the control valve 33 may be placed on the tank 1 or at another location, for example embedded in a wall or in the floor.

Figures 2, 3:
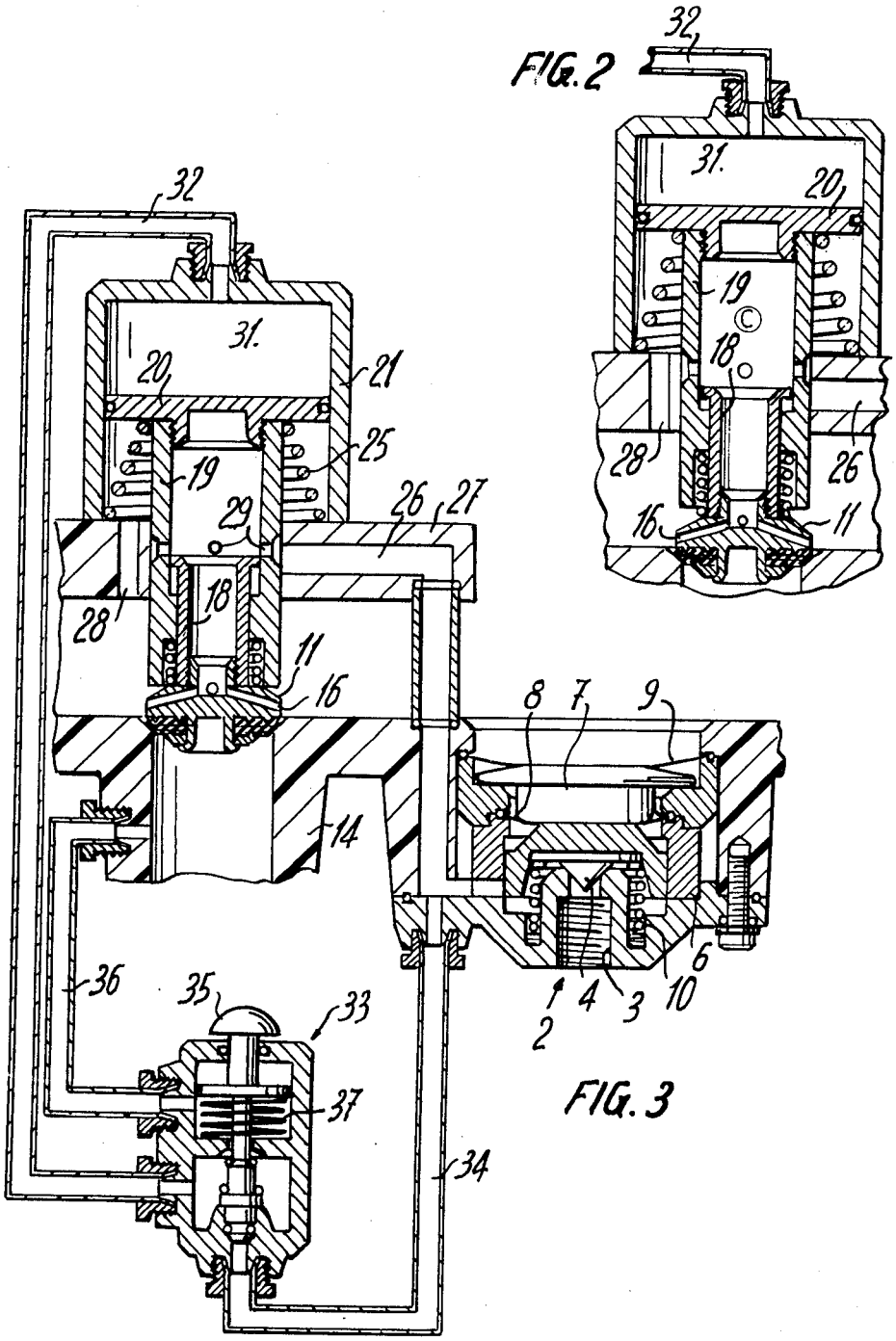
FIG. 2 is a cross-section of a portion of the device of FIG. 1 with the flushing valve in its closing position.
FIG. 3 is a view similar to FIG. 1, with the flushing valve in its closed position with related parts in position to permit the filling of the tank.

Operation of the described device is as follows:

When the tank 1 has been emptied, the various parts are located in the position of FIG. 1. The filling water delivered by union 3 can flow into duct 26 and pipe 34, since cone 4 is in the open position. However, the filling water cannot flow through duct 26 which is closed by the shank 19 of piston 20. The water thus flows through pipe 34 and valve 33 into pipe 32 and space 31 and comes to exert its pressure on the piston 20 which it pushes down against the action of spring 25. The downward movement of piston 20 closes seat 13 by means of valve 11 and, as shown in FIG. 2, the downward movement of piston 20 can continue against the action of spring 24 which allows sleeve 18 to slide in shank 19.

The continued downward movement of shank 19 brings groove 30 to face duct 26 whereupon the filling water can pass through holes 29 into the hollow shank 19 and sleeve 18 and enter tank 1 via the radial ducts 16 of valve 11. The outlets of ducts 16 are in the immediate proximity of the bottom of tank 1 and the ducts 16 are directed substantially "tangentially" to this bottom, so that filling of the tank 1 takes place very silently. During filling, the air trapped in tank 1 above the water level is compressed so that the tank is placed under pressure. When the pressure reaches the value set by spring 10, it causes a displacement of the differential piston formed by parts 6 and 7, against the action of spring 10, and closes valve cone 4. The device is hence ready for a flushing operation. Even in the case of stoppage of the supply of water, the tank 1 remains under pressure because the cone 4 is closed and acts as a retaining valve.

To actuate flushing, the plunger 35 of valve 33 is moved against the action of spring 37. When plunger 35 is depressed, its lower end closes pipe 34 and the pipe 32 is connected to atmospheric pressure by pipe 36. The pressure in space 31 above piston 20 consequently drops, and the piston 20 is pushed up by the combined action of spring 25 and the pressure of the water in tank 1, which pressure is transmitted by the duct 28 in support plate 27. As the piston 20 moves up, its shank 19 comes to obturate duct 26 and valve 11 is then lifted from its seat 13 to evacuate the pressurized water from tank 1 via sleeve 14.

To flush a small quantity of water, for example to damp the W.C. bowl before use, the user will rapidly release plunger 35 of control valve 33, so that after a small quantity of water has been delivered, the piston 20 is pushed down by the pressure re-established in pipe 32.

To completely clean the W.C. bowl, the user maintains a pressure on plunger 35 of valve 33 so that tank 1 may completely empty itself. The water is flushed violently since its initial pressure may, for example, be between 2 and 3kg/cm$^2$.

When the tank is completely emptied of water, the various parts are once more in the position of FIG. 1. The inside of tank 1 is in communication with the external air via sleeve 14 since the valve 11 is in the open position. It is hence ensured that after each complete emptying, the tank 1 is in the desired conditions for satisfactory operation.

The described device is very advantageous since, with the exception of the membranes/and springs, all of the parts can be in injection-molded thermoplastic resins. Moreover, the pressure exerted on the valve 11 is substantially constant, which avoids any excessive stressing of joint 12 and, at the same time, any risk of unwanted outflow. Furthermore, no internal leaks are to be feared as the pressure is equal in all parts of the mechanism.

Of course, numerous modifications may be provided. For example, the piston 20 could be replaced by another form of hydraulic actuator such as a membrane device. Likewise, it would be possible to provide a mechanism, sensitive to movement of the flushing valve and acting on a valve controlling the delivery of water into the tank, to replace the arrangement on shank 19 which acts as a slide valve.

I claim:

1. A water flushing device comprising: a fluid-tight tank; means for delivering water to the tank to trap and compress a quantity of air in the tank above the level of water; means defining a water-flushing outlet in the tank; a tank flushing valve movable between a closed position closing said outlet and an open, flushing position, hydraulic actuating means controlling said flushing valve, said actuating means including a cylinder, a piston slidable in said cylinder, said flushing valve slidably connected with said piston, spring means normally biasing said piston in an upward direction and said flushing valve to an open flushing position; and piston including a slide valve for preventing the delivery of water to the tank when said flushing valve is in the open position, said piston further including an upper face and a lower face, a control valve, first pipe means connected with said control valve and with the top of said cylinder above the upper face of said piston, second pipe means connected with said means for delivering water to the tank and with said control valve, third pipe means connected with said control valve and the atmosphere, whereby actuation of said control valve permits selective connection of the upper face of said piston to water pressure or to atmospheric pressure through said first and third pipe means respectively, causing said flushing valve to move between an open and closed position and causing said slide valve to turn on the water supply to the tank when the flushing valve closes and cut off the water supply to the tank when the flushing valve opens.

2. A water flushing device comprising: a fluid-tight tank; means for delivering water to the tank to trap and compress a quantity of air in the tank above the level of water; means defining a water-flushing outlet in the tank; a tank flushing valve movable between a closed position closing said outlet and an open, flushing position, hydraulic actuating means controlling said flushing valve, said actuating means including a cylinder, a piston slidable in said cylinder, said flushing valve slidably connected with said piston, spring means normally biasing said piston in an upward direction and said flushing valve to an open flushing position; said piston including a slide valve for preventing the delivery of water to the tank when said flushing valve is in the open position, said piston further including an upper face and a lower face, said slide valve comprising a hollow shank movable with the piston, said flushing valve carried by a support slidably mounted in said hollow shank, abutment means between said support and said hollow shank defining a rest portion of said support and said shank and a spring biasing said support to the rest position, a control valve, first pipe means connected with said control valve and with the top of said cylinder above the upper face of said piston, second pipe means connected with said means for delivering water to the tank and with said control valve, third pipe means connected with said control valve and the atmosphere, whereby actuation of said control valve permits selective connection of the upper face of said piston to water pressure or to atmospheric pressure through said first and third pipe means respectively, causing said flushing valve to move between an open and closed position and causing said slide valve to turn on the water supply to the tank when the flushing valve closes and cut off the water supply to the tank when the flushing valve opens.

3. A device according to claim 2, in which said support of the flushing valve is hollow and connects the inside of said hollow shank with at least one duct in said flushing valve, said at least one duct leading into the tank in the proximity of the bottom thereof when said flushing valve is in the closed position.

* * * * *